US007341489B2

(12) United States Patent
Kuo

(10) Patent No.: US 7,341,489 B2
(45) Date of Patent: Mar. 11, 2008

(54) ELECTRONIC CARD CONNECTOR

(75) Inventor: Ming-Lun Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/638,331

(22) Filed: Dec. 12, 2006

(65) Prior Publication Data

US 2007/0093099 A1 Apr. 26, 2007

Related U.S. Application Data

(63) Continuation-in-part of application No. 11/347,129, filed on Feb. 3, 2006, now Pat. No. 7,147,495, which is a continuation of application No. 11/028,051, filed on Dec. 31, 2004, now Pat. No. 7,090,513, and a continuation-in-part of application No. 10/982,281, filed on Nov. 5, 2004, now Pat. No. 7,198,517.

(30) Foreign Application Priority Data

Nov. 18, 2003 (TW) ..... 92220365 U
Jun. 11, 2004 (TW) ..... 93116822 A

(51) Int. Cl.
*H01R 24/00* (2006.01)

(52) U.S. Cl. ..... 439/630; 439/607

(58) Field of Classification Search ..... 439/607, 439/159, 160, 630
See application file for complete search history.

(56) References Cited

U.S. PATENT DOCUMENTS 6,120,322 A 9/2000 Ho et al.
7,198,517 B2 * 4/2007 Kuo ..... 439/607

FOREIGN PATENT DOCUMENTS

| | | |
|---|---|---|
| TW | 266819 | 12/1995 |
| TW | 311805 | 2/1997 |
| TW | 476465 | 2/2002 |
| TW | 534485 | 5/2003 |
| TW | 536020 | 6/2003 |
| TW | 553525 | 9/2003 |
| TW | 555220 | 9/2003 |
| TW | 559306 | 10/2003 |

* cited by examiner

*Primary Examiner*—Ross Gushi
(74) *Attorney, Agent, or Firm*—Wei Te Chung

(57) ABSTRACT

An electronic card connector (100) comprises an insulating housing (10), a plurality of contacts (20) received in the insulating housing (10), and a shell (30) mounted on the insulating housing (10). The shell (30) comprises a top plate portion (320), a pair of side plate portions (322) and a pair of bottom plate portions (324). A plurality of spring arms (321, 325) is stamped from the top plate portion (320) and the bottom plate portions (324). The spring arms (321) stamped from the top plate portion (320) and the spring arms (325) stamped from the bottom plate portions (324) define a pair of guide recesses (34) to guide an electronic card into the insulating housing (10). All the spring arms (321, 325) can mechanically and electrically connect with the inserted electronic card reliably and perform ESD function.

20 Claims, 8 Drawing Sheets

ELECTRONIC CARD CONNECTOR

This application is a continuation-in-part application of the application Ser. No. 10/982,281 filed Nov. 5, 2004 now U.S. Pat. No. 7,198,517, and claiming Taiwan priority 92220365 filed on Nov. 18, 2003, and a continuation-in-part application of the application Ser. No. 11/347,129 filed Feb. 3, 2006, now U.S. Pat. No. 7,147,495, which is a continuation application of application Ser. No. 11/028,051 filed on Dec. 31, 2004 and claiming the TW priority 93116822 filed on Jun. 11, 2004, now U.S. Pat. No. 7,090,513.

FIELD OF THE INVENTION

The present invention generally relates to an electronic card connector, and more particularly to an electronic card connector used in notebook computer for receiving an electronic card.

DESCRIPTION OF RELATED ART

U.S. Pat. No. 6,120,322 discloses a card connector including an insulating housing, a plurality of contacts received in the housing and a shell. The insulating housing has a rear connector section for connecting with a card. A pair of guide racks extends forwardly from two lateral ends of the rear connector section for facilitating the insertion of the card into the rear connector section. The guide racks and the connector section define a space sufficient for accommodating the memory card. A pair of guide recesses is defined in the inner face of the guide racks for holding the memory card in its position to insure a good connection between the memory card and the rear connector section. The shell is positioned on and fixed to the insulating housing and covers the space defined by the rear connector section and the guide racks. Moreover, the shell has a pair of sidewalls fixed to the guide racks so that the shell can be mounted onto the connector firmly.

However, the pair of guide racks and the guide recesses therein not only complicate the manufacturing process but also add the manufacturing cost of the card connector. In addition, the pair of guide racks increases the width of the card connector, which is not desirable from the standpoint of the compactness.

Hence, an improved PC card connector is desired to overcome the disadvantages of the prior art.

SUMMARY OF THE INVENTION

Accordingly, an object of the present invention is to provide a low cost electronic card connector with simple manufacture process and compact structure arrangement.

In order to achieve the object set forth, an electronic card connector in accordance with the present invention comprises an insulating housing with a mating portion, a plurality of contacts received in the insulating housing, and a shell mounted on the insulating housing. The shell comprises a top plate portion, a pair of side plate portions extending vertically from opposite sides of the top plate portion and a pair of bottom plate portions extending toward each other from the lower ends of the side plate portions. The top plate portion, the side plate portions, and the bottom plate portions define a card receiving space for accommodating an electronic card. The top plate portion integrally forms a row of first spring arms which is bowed inwardly in a longitudinal direction thereof. Moreover, each of the bottom plate portions forms a row of second spring arms opposite to the first spring arms in a longitudinal direction thereof. The first spring arms and the second spring arms define a pair of guide recesses to guide the electronic card into the insulating housing. All the spring arms can mechanically and electrically connect with the electronic card reliably, and perform electrostatic discharge (ESD) function.

To achieve the above objects, an electrical card connector in accordance with the present invention comprises a dielectric housing having a plurality of connector terminals and defining a pair of slots on opposite ends thereof, a pair of soldering pieces, a shielding assembling on the dielectric housing and defining an insertion port for insertion therein of an electrical card, and an ejector for ejecting the electrical card received in the card connector. Each soldering pieces is formed with a perpendicular wall received respectively in a slot of the dielectric housing and a leg extending from the base to fix on a grounding pad of a printed circuit board. The shielding is formed with tabs extending from sidewalls thereof to abut against the corresponding base of the soldering pieces received in the slots to establish a grounding path between the shielding and the printed circuit board.

Other objects, advantages and novel features of the invention will become more apparent from the following detailed description of the present embodiment when take in conjunction with the accompany drawings.

DETAILED DESCRIPTION OF PREFERRED EMBODIMENTS

Figure 1:
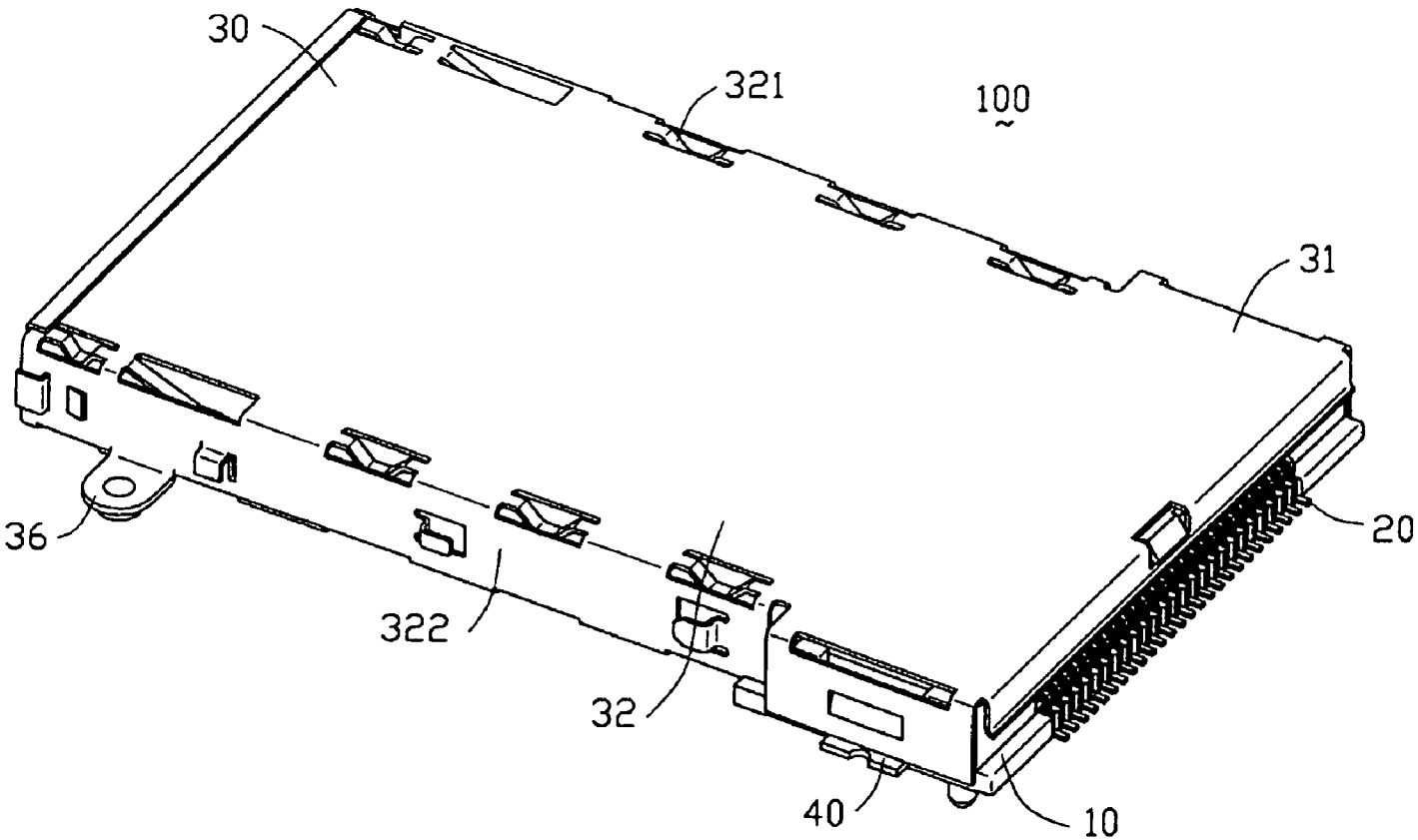
FIG. 1 is a perspective view of an electronic card connector in accordance with the present invention.

Because there are two embodiments in this application, the reference numbers may be double used. Anyhow, the second embodiment description uses the italic style to differ from the first embodiment description. Referring to FIG. 1, an electronic card connector 100 in accordance with the present invention includes an insulating housing 10, a plurality of contacts 20 received in the insulating housing, a shell 30 mounted on the insulating housing, and a connecting member 40.

Figure 2:
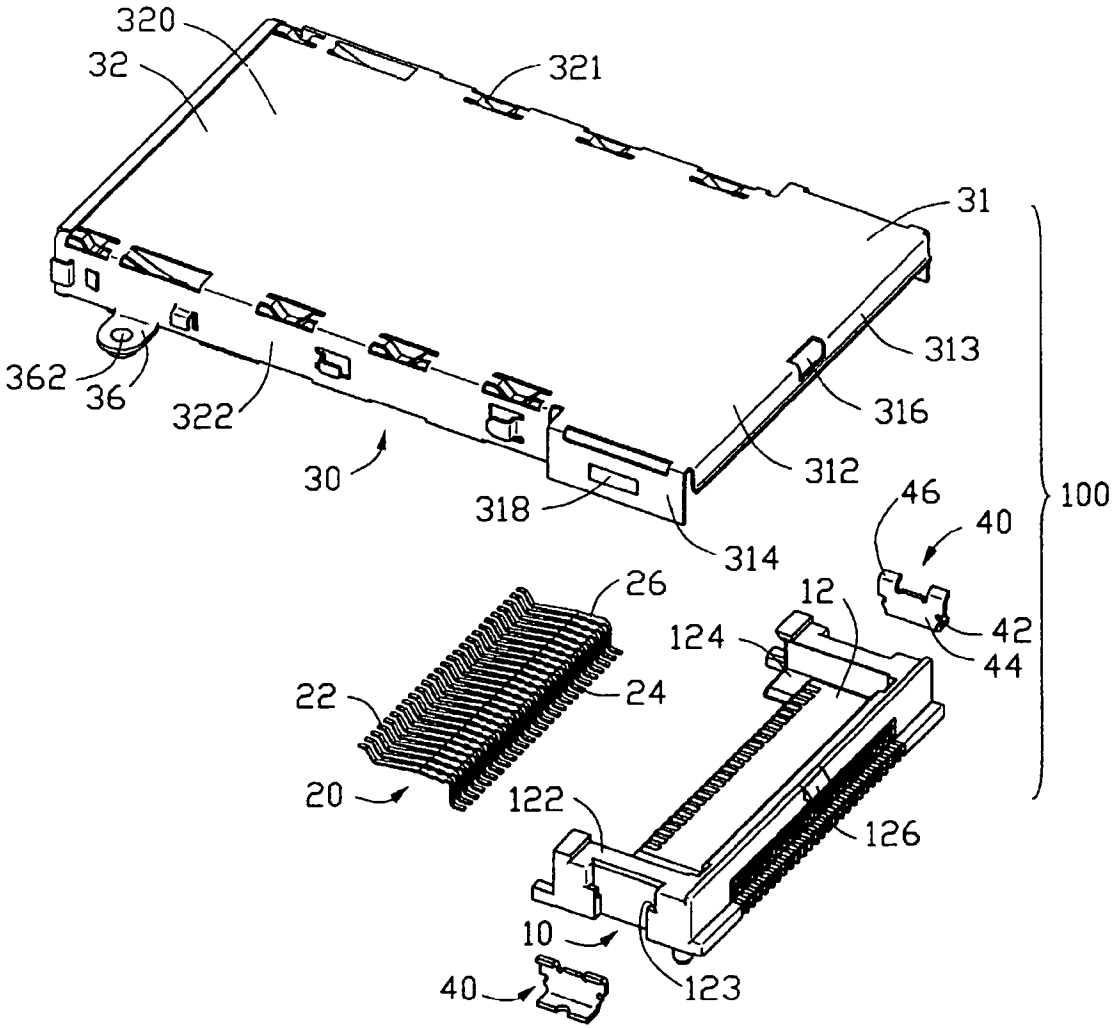
FIG. 2 is an exploded, perspective view of the electronic card connector shown in FIG. 1.

As shown in FIG. 2, the insulating housing 10 comprises a substantially rectangular mating portion 12 which extends in the longitudinal direction, a pair of side arms 122 parallelly extending rearwardly from two sides of the mating portion 12, and a bottom portion 124 connecting with the pair of side arms 122. A holding barb 126 protrudes from the front end of the mating portion. On the outer face of the side arms 122, a pair of retaining recesses 123 is defined. The holding barb 126 lies above the contacts 20 and is in the center of the mating portion in the longitudinal direction. The connecting member 40 comprises mounting portion 42, a pair of hooks 46, and a coupling portion 44 coupling the mounting portion 42 and the hooks 46.

The contacts 30 are received in the mating portion 12 of the insulating housing 10. Each of the contacts 30 includes a contacting portion 22 electrically connecting with an electronic card (not shown) inserted into the insulating housing, a soldering portion 24 for electrically connecting with a printed circuit board (not shown) and a retaining portion 26 connecting with the contacting portion 22 and the soldering portion 24. The retaining portion 26 is retained in the mating portion. The contacting portion 22 and the soldering portion 24 both are outside the mating portion 12.

Figure 3:
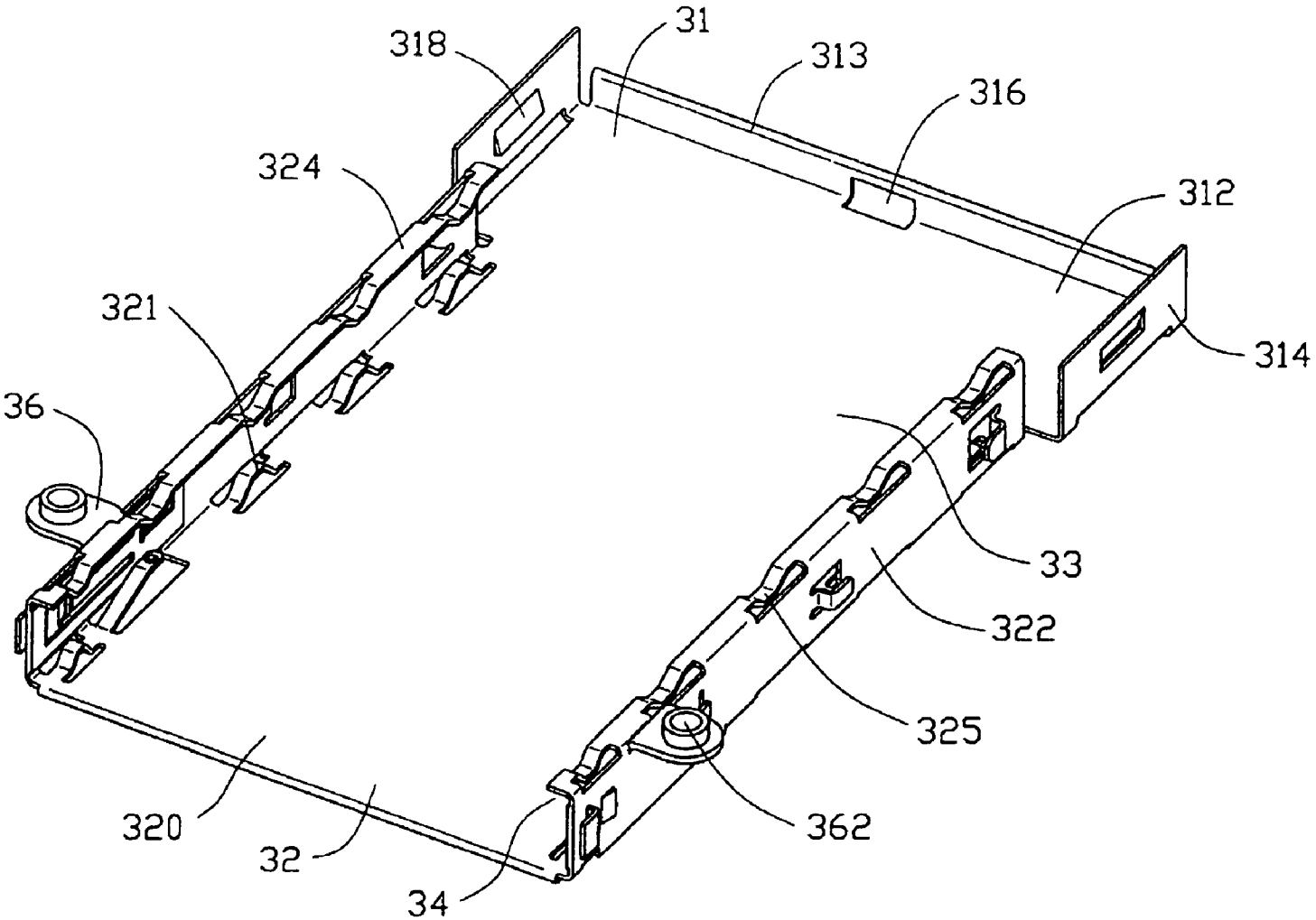
FIG. 3 is a perspective view of a shell of the electronic card connector in accordance with the present invention.

Referring to FIGS. 1-3, the shell 30 comprises a front portion 31 and a rear portion 32. The front portion 31 comprises a rectangular base 312, a pair of sidewalls 314 depending from the opposite edges of the base 312 and a stopper 313 extending vertically and downwardly from the front edge of the base 312. In the joint of the stopper 313 and the base 312, a notch 316 is defined. Additionally, in the sidewalls 314, a pair of elongated bars 318 is defined.

Turning to FIG 3, the rear portion 32 comprises a top plate portion 320, a pair of side plate portions 322 extending vertically from opposite sides of the top plate portion 320 and a pair of bottom plate portions 324 extending toward each other from the lower ends of the side plate portions 322. The top plate portion 320, the side plate portions 322 and the bottom plate portions 324 together define a card receiving space 33 and an inserting cutout (not labeled) for accommodating the electronic card. Further, a fixing portion 36 protrudes from the rear end of the side plate portion 322 with a hole 362 with a hole 362 therethrough. The top plate portion 320 integrally forms a row of first spring arms 321 which is bowed inwardly in a longitudinal direction thereof. Moreover, each of the bottom plate portions 324 forms a row of second spring arms 325 in longitudinal direction opposite to the first spring arms 321. The row of first spring aims 321 and the row of second spring arms 325 are both spaced equidistantly. The first spring arms 321 and the second spring arms 325 define a pair of guide recesses 34 therebetween to guide the electronic card into the insulating housing 10. As all the spring arms 321, 325 are bowed inwardly, they all can mechanically and electrically connect with the electronic card reliably, and perform ESD function. The top plate portion 320 further forms a pair of resilient arms (not labeled) projecting into the receiving space 33, each resilient arm is located between two adjacent spring arms 321 and adjacent to the inserting cutout.

Turning to FIG. 1, the coupling portion 44 of the connecting member 40 is retained in the retaining recess 123 on the outer face of the side arm 122 of the insulating housing. When the shell 30 is mounted on the insulating housing 10, the hooks 46 of the connecting member 40 engage with the elongated bars 318 defined in the sidewalls 314. The holding barb 126 clips the notch 316 defined in the joint of the base 312 and the stopper 313. Thus, the shell 30 is fixed to the insulating housing 10 firmly. In addition, the guide recesses 34 are defined between the first spring arms 321 and the second spring arms 325 of the shell 30. These arrangements not only make the manufacture process simple, material saved, but also make the electronic connector structure comparably compact. In other words, the cost is reduced greatly and the space in the notebook computers is made good use of. It is well known that all these advantages above-mentioned are very desirable in the computer industry field.

Figure 4:
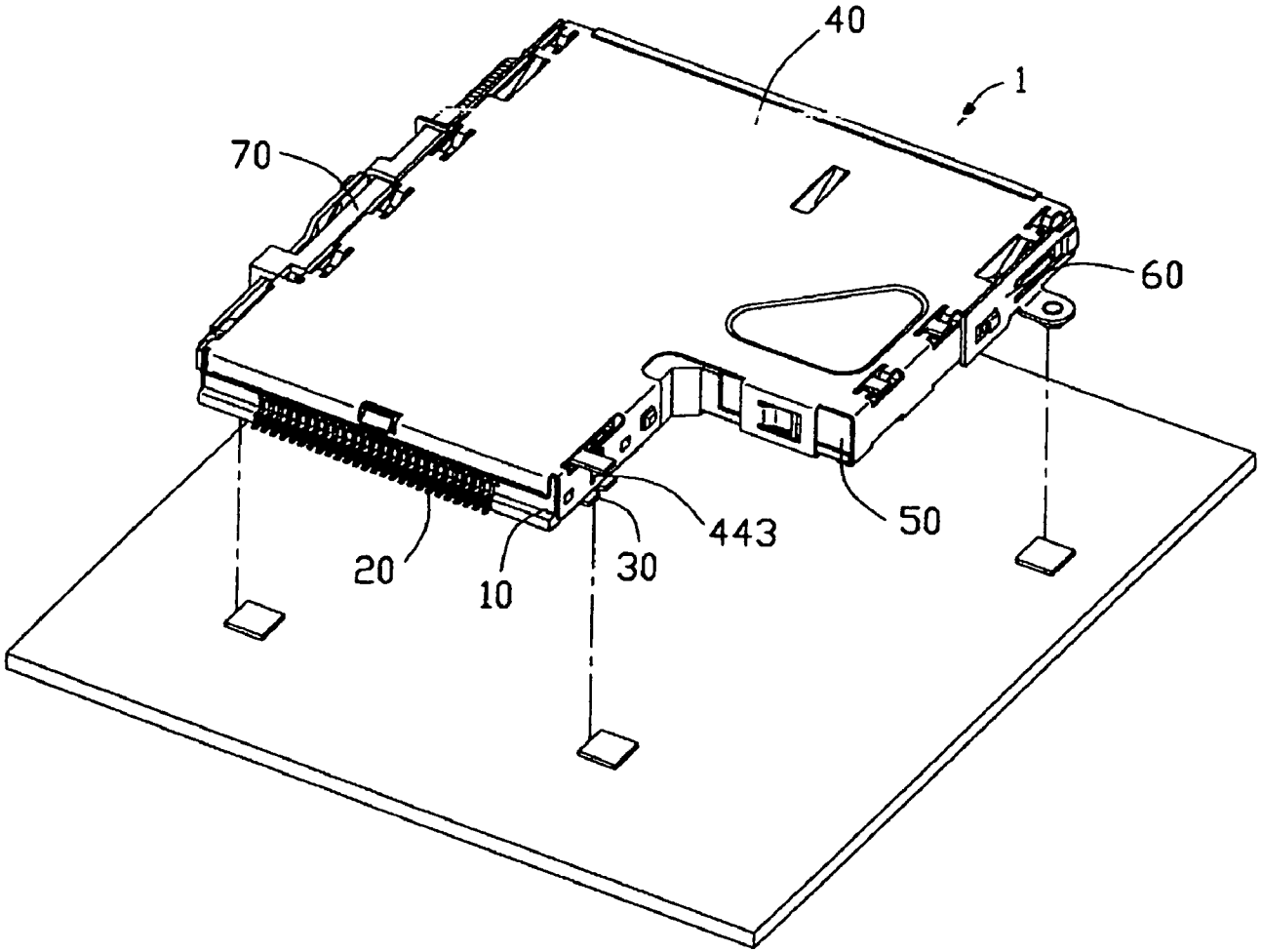
FIG. 4 is a perspective view of an electrical card connector in accordance with the present invention and a printed circuit board to which the electrical card connector is to be mounted.
Figure 5:
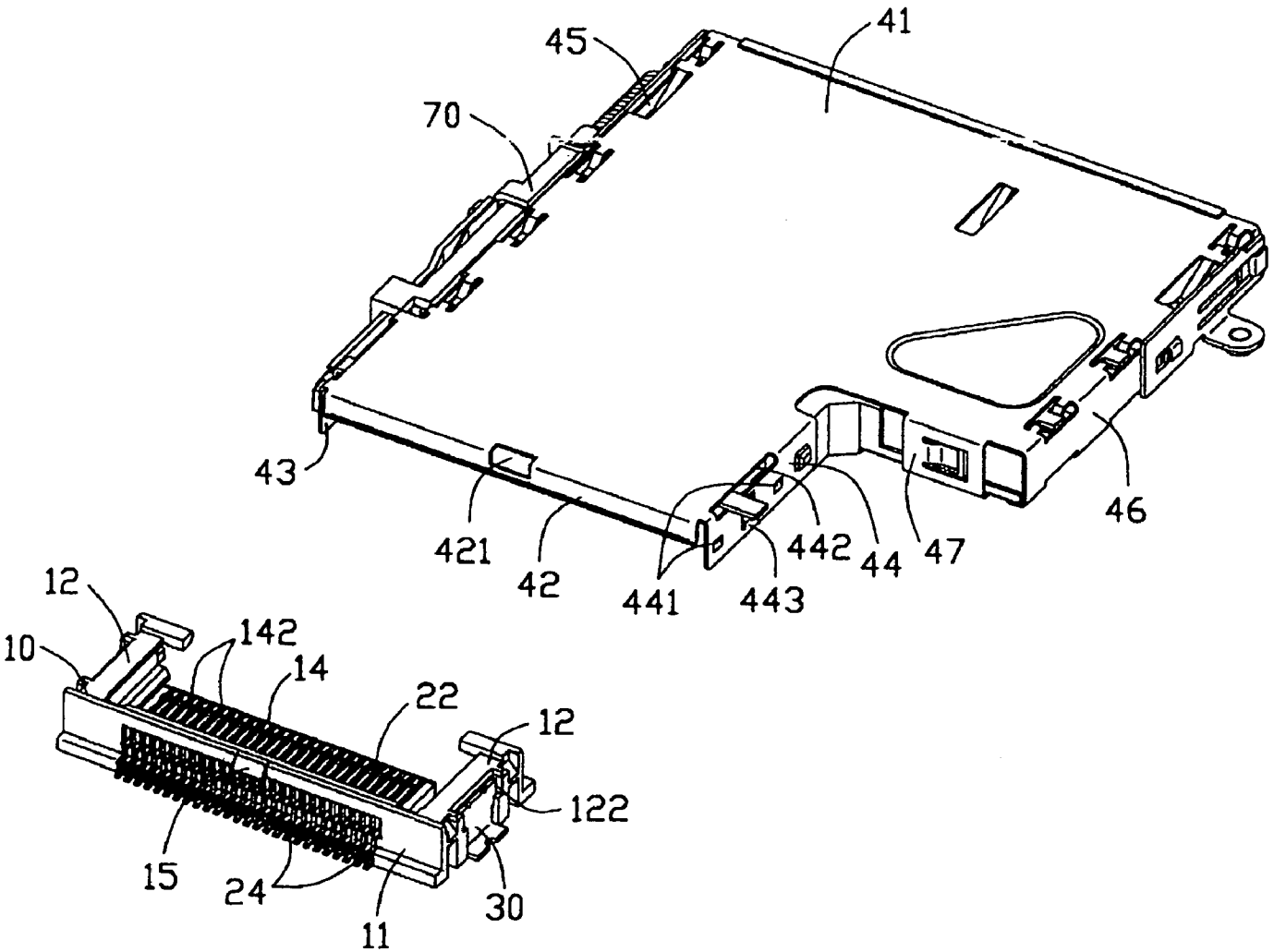
FIG. 5 is a perspective view of the electrical card connector shown in FIG. 1, wherein the shielding is not assembled.

Referring to FIG. 4 and FIG. 5, an electrical card connector 1 in accordance with the present invention comprises an elongated dielectric housing 10 having a plurality of connector terminals 20, a pair of soldering pieces 30 received in the dielectric housing 10, a shielding 40, a guide element 50, a pair of stand off devices 60 and an ejector 70.

Figure 6:
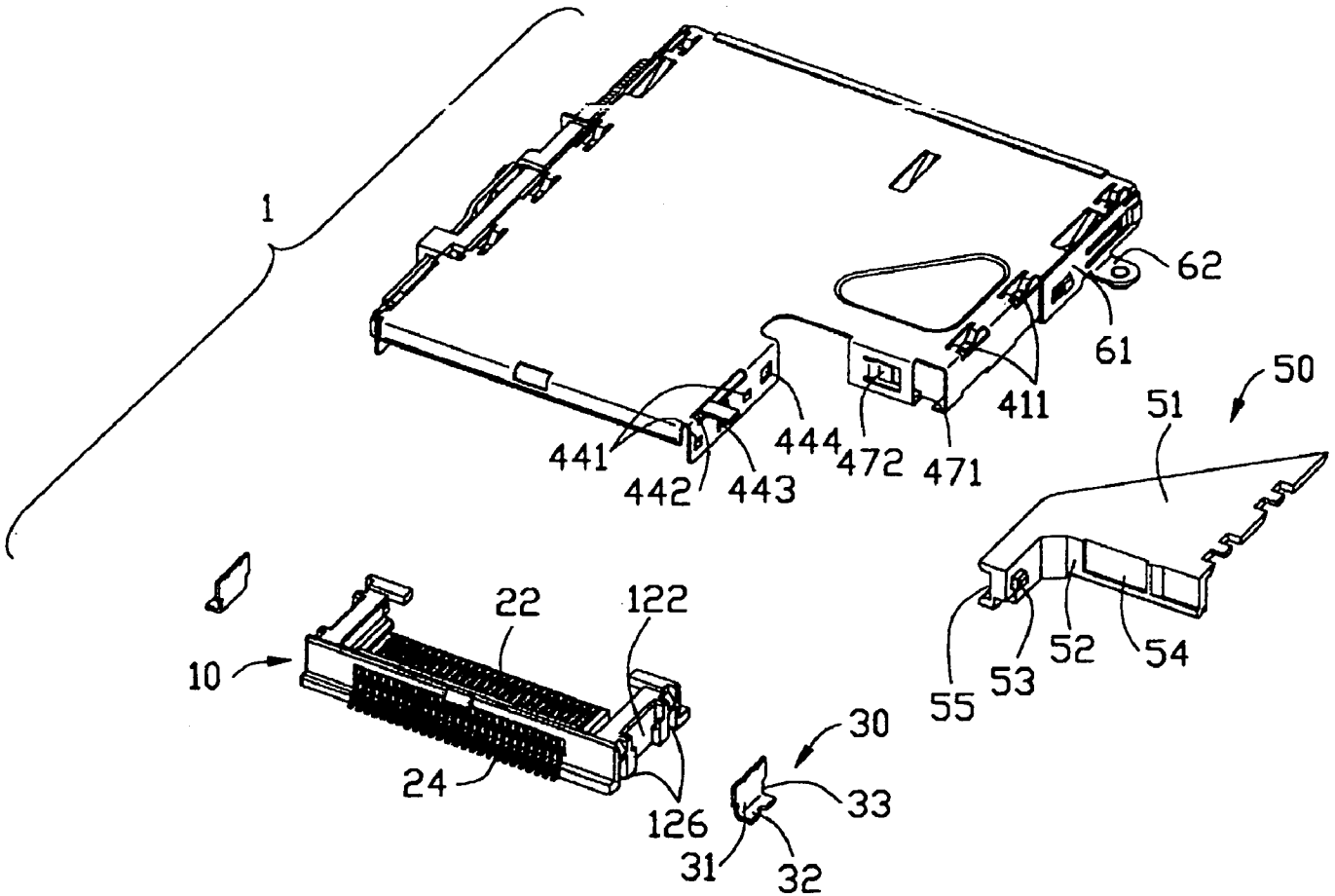
FIG. 6 is an exploded, perspective view of the card electrical connector shown in FIG. 2.

Referring to FIG. 5 and FIG. 6, the elongated dielectric housing 10 defining a card insertion/ejection direction has a base 11, a pair of guide racks 12 extending backwardly from opposite ends of the base 11 and a mating portion 14 extending from a central section of the base 11 and disposed between the two guide racks 12. The base 11 is formed with a block 15 at the front sidewall thereof for engaging with the shielding 40. Each guide rack 12 defines a slot 122 extending downwardly from the upper surface thereof and opening in a side face thereof Each guide rack 12 further defines a plurality of latch holes 126 besides the slot 122. The mating portion 14 is formed with a plurality of parallel channels 142 for receiving the connector terminals 20. Each connector terminals 20 has a contact portion 22 for electrical connecting with an electrical card, a tail 24 for electrically connecting with a printed circuit board and a fixing portion (not shown) disposed between the contact portion 22 and the tail 24 and fixed in the channels 142 of the dielectric housing 10.

The soldering pieces 30 are inserted into the slots 122 of the guide rack 12, respectively, and each of the soldering pieces 30 has a vertical wall 31 retained in the slot 122 with a plurality of stabs 33 formed on the side edge thereof interferentially engaging with an inner surface of the slot 122 and a leg 32 extending from the vertical wall 31 and protruding out of the dielectric housing 10 to fixing on a grounding pad of the printed circuit board. Since the slot 122 opens in the side face of the guide rack 12, a part of the vertical wall 31 is exposed.

Referring to FIGS. 4-8, the shielding 40 is formed and stamped a metallic sheet. The shielding has a main body 41 in an "L" type shape and a plurality of sidewalls extending downwardly from edges of the main body 41 to form a receptacle space for accommodating the electrical card cooperating with the main body 41. These sidewalls comprise a front wall 42 extending from a front edge of the main body 41, a first and a second sidewalls 43, 44 at opposite sides of the front wall 42, a third sidewall 45 disposed in the same side with the first sidewall 43, a fourth sidewall 46 disposed in the same side with the second sidewall 44 and a longitudinal sidewall 47. The first and the second sidewalls 43,44 are respectively adjacent to opposite ends of the front wall 42, the third and the fourth sidewalls 45,46 are respectively parallel to the first and the second sidewalls 43, 44, and the longitudinal sidewall 47 is disposed between the second sidewalls 44 and the fourth sidewall 46.

When the shielding 40 is assembled on the dielectric housing 10, the main body 41 covers an upper surface of the dielectric housing 10, the front sidewall 42 shields the front face of the dielectric housing 10 and defines a gap 421 to engage with the block 15 of the dielectric housing 10, and the first and the second sidewalls 43, 44 respectively cover the side face of the guide rack 12. The first sidewall 43 is formed with a plurality of latches 431 extending into corresponding latch holes 126 to fix the shielding 40 to the dielectric housing 10. The first sidewall 43 defines a cut 432 for the ejecting rod 75 of the ejector 70 passing there through. Further more the first sidewall 43 is formed with an elastic piece 433 extending inwardly to electrically abut against the corresponding soldering piece 30 received in the slot 122. The second sidewall 44 has a same configuration with the first sidewall 43, and has a plurality of latches 441, a cut 442 and an elastic piece 443 abutting against the corresponding soldering piece 30.

Horizontal plates 451,461 extends inwardly from hemlines of the third and the fourth sidewall 45,46, respectively. Guide grooves 452,453 are defined between the horizontal plates 451,461 and the main body 41 for guiding and holding the insertion/ejection of the electrical car. The horizontal plates 451,461 are formed with a plurality of extrusive slices 453,463 along the inserting direction of the electrical card, and the main body 41 is formed with a plurality of depressed slices 411 above the corresponding slices 453,463. The electrical card will not swash in an up and down direction in the receptacle space of the shielding 40 due to being resiliently sandwiched by these oppositely disposed slices 411,453,463. The longitudinal sidewall 47 is bended backwardly from a hemline thereof to form a receive portion 471 for the guide element 50 with a spring arm 472 extending to the receive portion 471.

Figure 7:
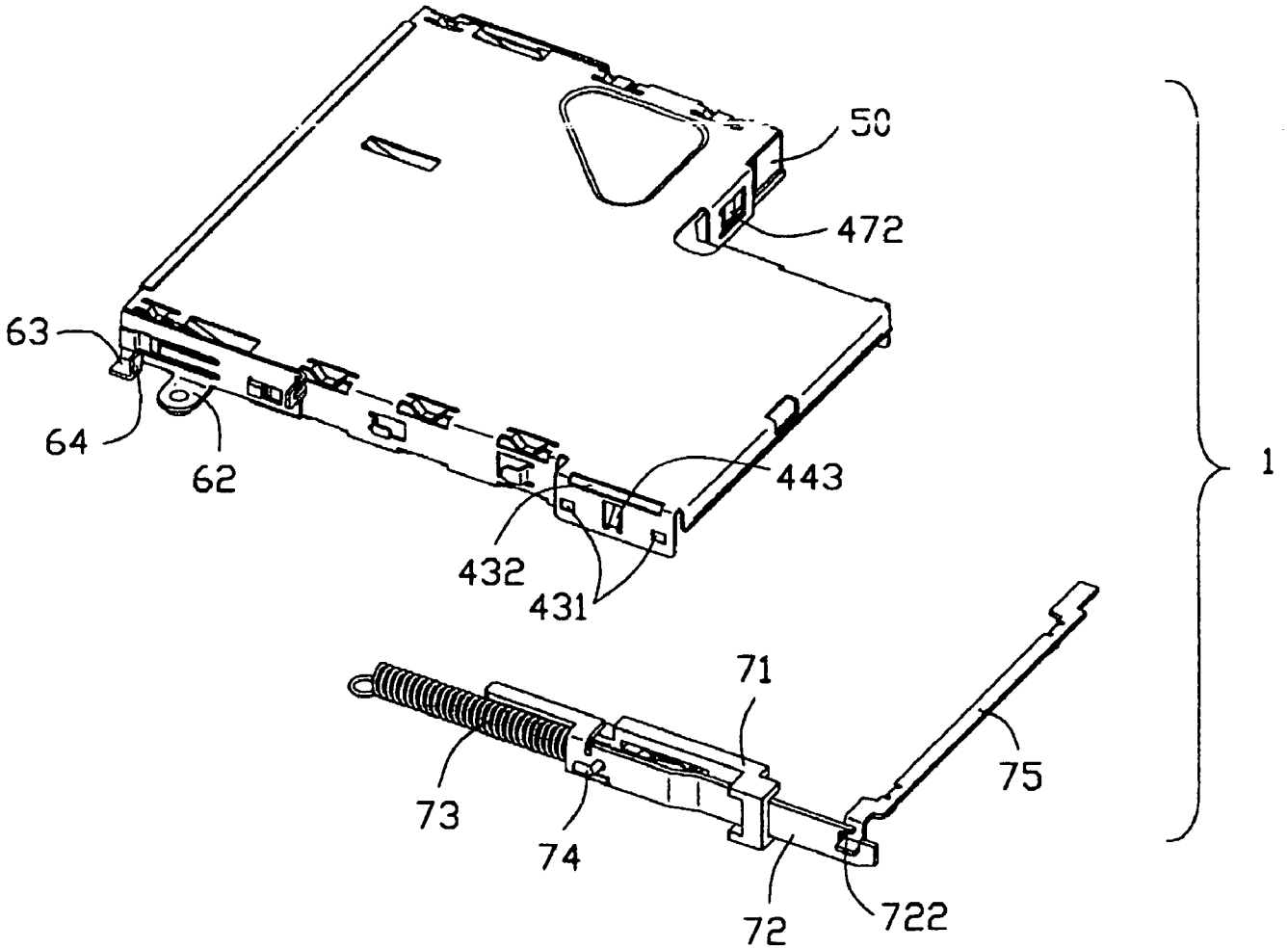
FIG. 7 is an exploded, perspective view of the shielding and an ejector of the card electrical connector shown in FIG. 5, taken from another angle.

Referring to FIGS. 5-7, the guider element 50 is approximately in a triangle shape, and has a board 51 and a "L" shape perpendicular wall 52 extending forwards and downwardly from the front of the board 51. The board 51 is received in the receive portion 471 of the longitudinal sidewall 47 and abuts against the fourth sidewall 46, the perpendicular wall 52 abuts against the second sidewall 44 of the shielding plate 40. The perpendicular wall 52 is formed with a projection 53 and a depressed portion 54 on an out surface thereof, the spring arm 472 of the longitudinal sidewall 47 is abutting against an inner sidewall of the depressed portion 54, and the second sidewall 44 of the shielding plate 40 is formed with a fixing hole 444 engaging with the projection 53 of the guider element 50. The perpendicular wall 52 is defined a guide channel 55 extending from the front portion of the perpendicular wall 52 for guiding the electrical card inserting into or ejecting out of the electrical card connector 1.

Each of the stand off device 60 has a flake 61 assembling on the shielding 40 and an engaging portion 62 soldered to a grounding pad of the printed board circuit. Further more the stand off device 60 in the same side with the ejector 70 is provided with an extrusive plate 63 with a tab 64 extending upwardly (referring to FIG. 4).

Figure 8:
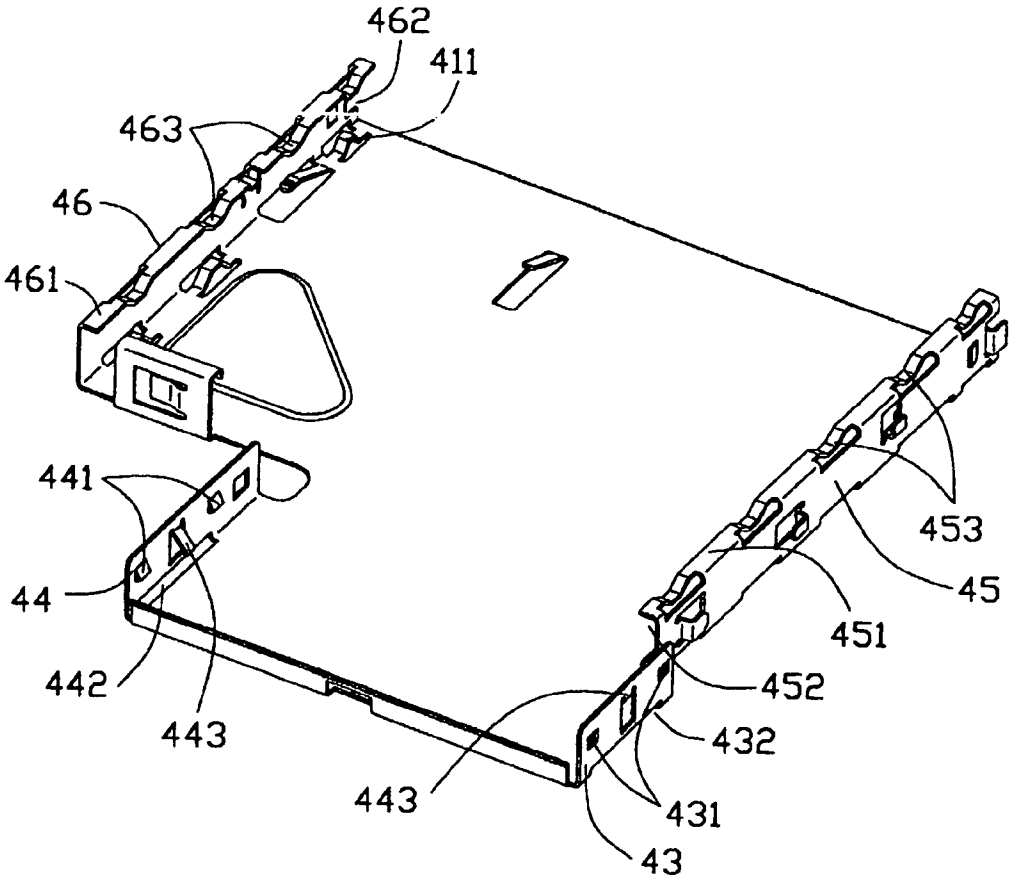
FIG. 8 is an bottom, perspective view of the shielding of the card electrical connector shown in FIG. 4.

Referring to FIG. 7 and FIG. 8, the ejector 70 is attached to the third sidewall 45 of the shielding plate 40 and comprises a holder member 71 having a heart groove, a push rod 72, a spring 73, a link pin 74 and an ejecting rod 75. The push rod 72 is slidely assembled on the holder member 71 with a limit hole 722 defined at an end thereof The spring 73 has a two ends, one end is fasten to the tab 64 of the stand off 60 assembled on the shielding 40, and the other clasps to the push rod 72 to drive the push rod 72 to slide toward an original position of the push rod 72. The link pin 74 connects with the push rod 72 and may slide in the heart groove of the holder member 71. The ejecting rod 75 is sandwiched in between the dielectric housing 10 and the shielding 40 by passing through the cuts 432, 442 of the shielding 40 and rotataly connecting with the push rod 72 via the limit hole 722.

The ejector 70 is a push-push type, during inserting the electrical card into the electrical card connector 100, a front face of the electrical card push the ejecting rod 75 to rotate, so that the push rod 72 is brought to move rearward along with the ejecting rod 75 and the link pin 74 slides in the heart groove. In this state, the spring 73 is deformed until the link pin 74 into a lock position of the heart groove, whereby the electrical card is fully inserted into the electrical card connector 1 and electrical connects with the contactor terminal 20. Pushing the electrical card forward again, the link pin 74 is released from the lock position, then the push rod 72 move forward driven by the resilience force of the spring 73 to bring the ejecting rod 75 to eject the electrical card out of the electrical card connector 1.

When the assembled electrical card connector 1 is mounting on the printed circuit board, the pair of soldering pieces 30 are soldered to the grounding pad on the printed circuit board to mount the dielectric housing 10 on the printed circuit board. Since the elastic pieces 433,443 of the shielding 40 abut against corresponding soldering pieces 30, so the grounding path of the shielding 40 is established by the soldering piece 30 and is closed to transfers interface to make the electrical card connector 1 get a good anti-EMI effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector, comprising:

an insulating housing comprising a substantially rectangular mating portion extending in a longitudinal direction;

a plurality of contacts received in the mating portion of the insulating housing; and a metallic shell, of which the insulating housing is mounted to a rear end, comprising a horizontal plate portion, a pair of side plate portions extending vertically from opposite lateral sides of the top plate portion, a pair of flange-like plate portions and the flange-like plate portions, and a plurality of spring arms formed on lateral side areas of the horizontal plate portion and the flange-like plate portions and bowed into the card receiving space and defining a pair of guiding recesses between the spring arms;

wherein each of said spring arms is stamped from the metallic shell with two opposite ends thereof integrally connected to said metallic shell;

wherein at least one cantilever resilient arm is aligned with and located between adjacent two of said aligned spring arms in a front-to-back direction perpendicular to said longitudinal direction.

2. A card connector for receiving a card, comprising:

an insulating housing comprising a substantially rectangular mating portion extending in a longitudinal direction;

a plurality of contacts received in the mating portion of the insulating housing; and a shell mounted on the insulating housing and comprising a top plate portion, a pair of side plate portions extending vertically from opposite sides of the top plate portion, a pair of bottom plate portions extending toward each other from lower ends of the side plate portions, a card receiving space defined by the top plate portion, the side plate portions and the bottom plate portions, and a plurality of spring arms formed on each of the top plate portion and the bottom plate portions, the spring arms bowed into the card receiving space and defining a pair of guiding recesses between the spring arms formed on the top plate portion and on the bottom plate portions, each spring arm has two ends, respectively, connecting with the shell in a card inserting direction, and is separated with the shell in a lateral direction perpendicular the card inserting direction.

3. The card connector as described in claim 2, wherein the spring arms of the top plate portion and the bottom plate portions are all spaced equidistantly along a longitudinal direction of the shell.

4. The card connector as described in claim 2, wherein a fixing portion protrudes from a rear end of the side plate portion of the shell, and wherein a hole is defined in the fixing portion.

5. The card connector as described in claim 2, wherein the top plate portion of the shell comprises a resilient arm projecting into the receiving space, the resilient arm is sandwiched by two adjacent spring arms and adjacent to the inserting cutout.

6. The card connector as described in claim 2, further comprising a pair of connecting members for fixing the shell to the insulating housing.

7. The card connector as described in claim 6, wherein the connecting member comprises a mounting portion, a coupling portion and a pair of hooks.

8. The card connector as described in claim 7, wherein the shell includes a front portion and a rear portion, the front portion comprising a rectangular base, a pair of sidewalls depending from the opposite edges of the base, a stopper extending vertically and downwardly from a front edge of the base, and a notch defined in a the joint of the stopper and the base, and wherein a pair of elongated bars is defined in the sidewalls for engaging with the hooks of the connecting member.

9. The card connector as described in claim 8, wherein the insulating housing comprises a pair of side arms parallelly extending along two sides of the mating portion, and wherein a holding barb protrudes from a front end of the mating portion to clip the notch of the shell.

10. The card connector as described in claim 9, wherein a retaining recess is defined on an outer face of the side arms for retaining the connecting member.

11. A card connector comprising:

an insulating housing comprising a mating portion extending in a transverse direction;

a plurality of contacts received in the mating portion of the insulating housing; and an L-shaped metallic shell, of which the insulating housing is mounted to a rear end so as to commonly define an L-shaped card receiving cavity, comprising a horizontal plate portion defining a pair of opposite outer side edges and one intermediate edge located between said pair of outer side edges in said transverse direction under a condition that all said pair of outer side edges and said intermediate edge extend along a front-to-back direction perpendicular to said transverse direction, a pair of projecting arms formed adjacent to said outer side edges, respectively; wherein another projecting arm is located between said pair of projecting arms in said transverse direction, and further essentially aligned with said intermediate edge along said front-to-back direction; wherein all said pair of projecting arms and said another projecting arm extend inwardly toward the card receiving cavity in a vertical direction perpendicular to both said transverse direction and said front-to-back direction.

12. The card connector as claimed in claim 11, wherein said another projecting arm is transversely aligned with said pair of projecting arms in said transverse direction.

13. The card connector as claimed in claim 11, wherein said pair of projecting arms and said another projecting arm are all cantilevered.

14. The card connector as claimed in claim 11, wherein a pair of side wall structures are formed around said two opposite outer side edges for guiding a corresponding card.

15. The card connector as claimed in claim 11, wherein a side wall structure is formed around said intermediate edge for guiding a corresponding card.

16. The card connector as claimed in claim 11, wherein said horizontal plate is essentially roughly planar.

17. The card connector as claimed in claim 11, wherein said pair of projecting arms are resilient.

18. The card connector as claimed in claim 11, wherein said another projecting arm is resilient.

19. The card connector as claimed in claim 11, further comprising a pair of groups of spring arms respectively located around said pair of outer side edges to form a pair of guiding recesses thereabouts.

20. The card connector as claimed in claim 19, wherein said pair of groups of spring arms each having two opposite ends unitarily linked to the horizontal plate.

* * * * *